United States Patent [19]

Carroll et al.

[11] 4,102,431

[45] Jul. 25, 1978

[54] EMERGENCY PERSONNEL LOWERING APPARATUS

[75] Inventors: Charles E. Carroll, Kettering; William H. Hobbs, Centerville, both of Ohio

[73] Assignee: The United States of America as represented by the Secretary of the Air Force, Washington, D.C.

[21] Appl. No.: 815,136

[22] Filed: Jul. 13, 1977

[51] Int. Cl.[2] ..... A62B 1/14

[52] U.S. Cl. ..... 182/5; 188/65.5

[58] Field of Search ..... 182/5, 6, 7, 3; 188/65.5, 65.4, 65.1, 65.2

[56] References Cited

U.S. PATENT DOCUMENTS

| | | | |
|---|---|---|---|
| 542,641 | 7/1895 | Hembacher | 188/65.5 |
| 586,173 | 7/1897 | Frahm | 182/5 |
| 933,685 | 9/1909 | Wray | 188/65.5 |
| 946,588 | 1/1910 | Thuener | 182/5 |
| 1,463,149 | 7/1923 | Barthelemy | 188/65.5 |
| 3,419,236 | 12/1968 | Weber | 182/5 |

*Primary Examiner*—Reinaldo P. Machado
*Attorney, Agent, or Firm*—Joseph E. Rusz; Richard J. Killoren

[57] ABSTRACT

An emergency personnel lowering apparatus having a stowage bag including a lowering line stowed in a plurality of hanks within the bag. A lowering control mechanism and an attachment line are positioned within the bag adjacent the lowering line. A portion of the attachment line extends out of the bag and forms a pull loop. The lowering control mechanism includes an adjustable descent control mechanism which controls the area of contact between different portions of the lowering line to control the rate of descent. Plural paths are provided for the lowering line in the descent control mechanism to adapt the system for different loads. A brake mechanism is provided to stop descent if the person on the line becomes incapable of self protection on the ground.

6 Claims, 11 Drawing Figures

PULL
22'
22
30
12
20
57
7
94
87
8
38
93
55
86
99
101
102
32
30'
33
6
47
44
34
36
55
54
56
90
53
84
98
9
95
105
51
50
14

EMERGENCY PERSONNEL LOWERING APPARATUS

RIGHTS OF THE GOVERNMENT

The invention described herein may be manufactured and used by or for the Government of the United States for all governmental purposes without the payment of any royalty.

BACKGROUND OF THE INVENTION

This invention relates to an emergency personnel lowering apparatus.

Various systems have been used for controlling the rate of descent of a person on a lowering line and for stopping the movement along the line. The patents of Hobbs, U.S. Pat. No. 3,695,397, and Ledner, 3,799,289, show known systems for controlling the rate of descent of a person along an emergency lowering line. The patents to Nickson, U.S. Pat. No. 1,576,210; Schultz, U.S. Pat. No. 2,343,086; and Houseman, U.S. Pat. No. 2,561,514, show various types of line braking devices.

The patent to Weber, U.S. Pat. No. 3,419,236, relates to the particular problem of rescuing downed aircrewmen from marooned positions in high trees.

For the rescue of downed aircrewmen a more compact system is needed which will also provide a much greater range of control in the rate of descent. Also, the prior art systems, which depend upon friction between different portions of the lowering line for controlling the rate of descent, may be useful for only a limited weight range of aircrewmen. If the aircrewman becomes incapable of self protection on the ground it would be safer if he were left suspended from the lowering line.

BRIEF SUMMARY OF THE INVENTION

According to this invention a personnel lowering system is provided in a compact package which is carried on the aircrewman. The personnel lowering system includes an emergency lowering line assembly; a lowering control mechanism which is positioned adjacent the lowering line in the package. The lowering line passes through the lowering control mechanism and is secured to an attachment line which is positioned adjacent the lowering control mechanism within the package.

The lowering control mechanism includes a descent control mechanism which acts to control the area of contact between different portions of the lowering line to control the rate of descent. Plural paths for the lowering line are provided within the descent control mechanism to permit the use of different numbers of contact areas between different portions of the line to adapt the use of the apparatus for different weight aircrewmen. A braking mechanism is provided within the lowering control mechanism to stop the descent of the aircrewman if he should become incapable of self protection. The brake mechanism includes a latch mechanism so that the brake mechanism can be locked out of engagement with the lowering line, if desired.

IN THE DRAWING

DETAILED DESCRIPTION OF THE INVENTION

Figure 1:
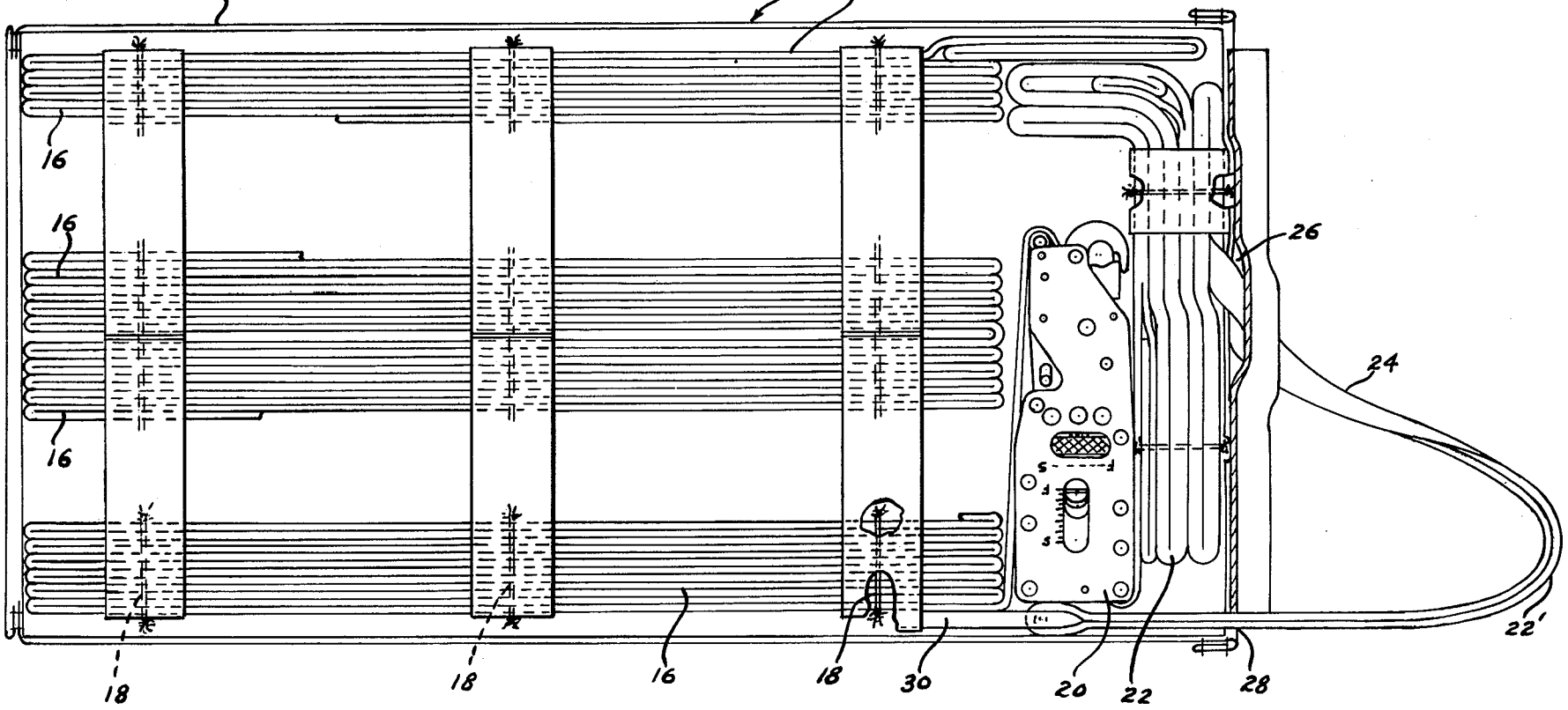
FIG. 1 is a schematic diagram showing the personnel lowering apparatus of the invention.

Reference is now made to FIG. 1 of the drawing which shows an emergency personnel lowering apparatus 10 having a stowage bag 12 with an emergency lowering line 14 stowed therein, in a conventional manner, in a plurality of hanks 16 held together by break stitches 18. The bag 12 has conventional snap fasteners, not shown, for securing the lowering apparatus to an aircrewman.

The lowering line passes through a lowering control mechanism 20 which is stowed, in the bag 12, adjacent to hanks 16. An attachment line 22 is secured to line 14 and is stowed in bag 12 adjacent to the lowering control mechanism 20. A section 24 of the line 22 extends through a partially opened flap 26 in bag 12. The flap 26 is held closed with conventional hook and loop Velcro fasteners. The end portion of the line 22 passes back into the stowage bag 12 through an opening 28 at the end of flap 26 and attaches to a toggle member 30 which is releasably held in the bag 12 adjacent one of the hanks 16.

Figures 2, 3, 4, 5:
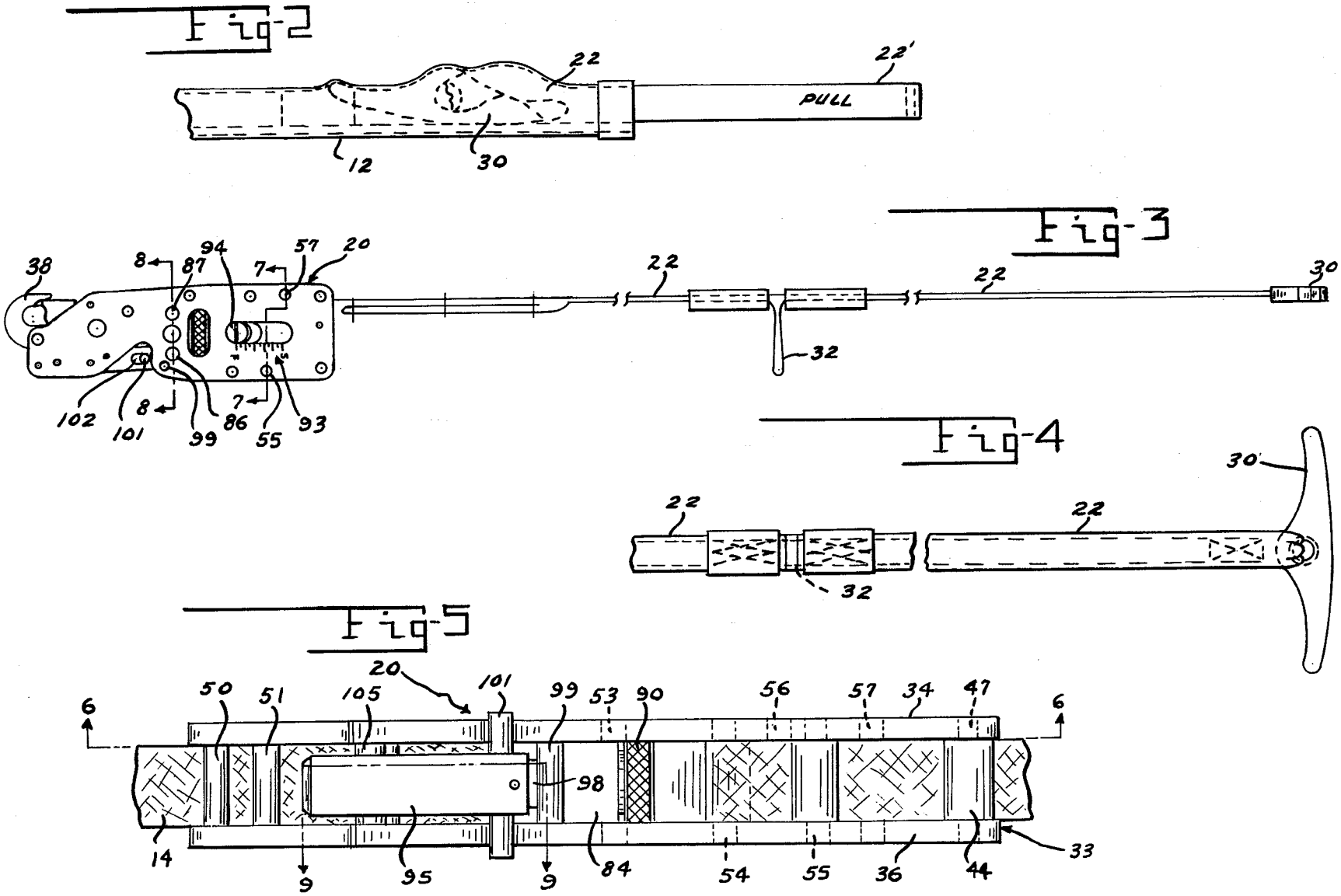
FIG. 2 is a partially cut away side view of the device of FIG. 1.
FIG. 3 is a schematic view of the lowering control mechanism and partially cut away extended attachment line for the device of FIG. 1.
FIG. 4 is a bottom view of a portion of the attachment line of FIG. 3.
FIG. 5 is a partially schematic side view of the lowering control mechanism of FIG. 1.

The portion 22' of line 22 forms a pull loop for extracting the line 22, toggle 30 and lowering mechanism 20 from the bag 12. The attachment line, after being extracted from bag 12 is secured to a support member such as a structural member on a building, a tree limb or to parachute risers as shown in FIG. 1 of the patent to Weber. The line 22, shown in FIGS. 3 and 4, is secured by passing the line over the support member and then by passing the toggle 30 through a loop 32 on line 22. More than one loop 32 may be provided on line 22 to permit attachment to support members of different sizes.

Figure 6:
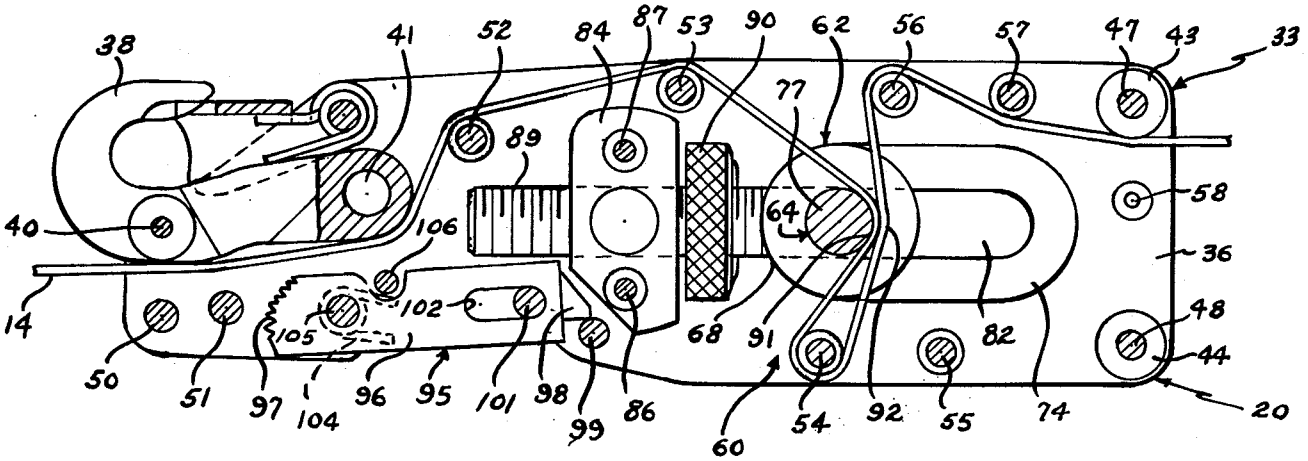
FIG. 6 is a partially schematic top plan view of the device of FIG. 5 with the top frame member removed.
Figure 7:
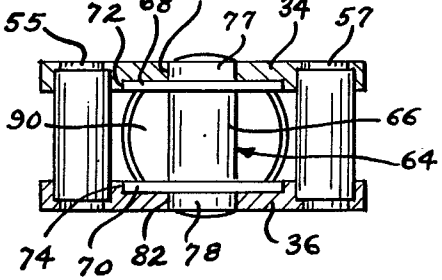
FIG. 7 is a sectional view of the device of FIGS. 5 and 6 taken along the line 7—7 of FIG. 3.

The lowering control mechanism 20, shown in FIGS. 5 and 6, has a support frame 33 having two spaced frame members 34 and 36. A hook 38, for securing the lowering control mechanism to a metal loop on the aircrewman's parachute harness, is rigidly secured between frame members 34 and 36 by pins 40 and 41. The hook 38 acts as a spacer between the frame members 34 and 36 at one end of the lowering control mechanism. A pair of spacers 43 and 44 are positioned at the other end of frame members 34 and 36 and pins 47 and 48 pass through the spacers 43 and 44 and frame members 34 and 36 and are secured by upsetting the ends of the pins. The ends of pin 40 are also upset to secure the frame members 34 and 36 to the hook 38. A plurality of guide rollers 50, 51, 52, 53, 54, 55, 56, 57 and 58 have end portions which are journaled into frame members 34 and 36, as shown for pins 55 and 57 in FIG. 7.

Figure 8:
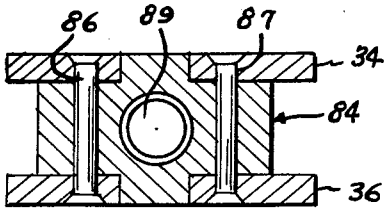
FIG. 8 is a sectional view of the device of FIGS. 5 and 6 taken along the line 8—8 of FIG. 3.

A descent control mechanism 60 includes roller guides 54, 55, 56 and 57 and an adjustment device 62. The adjustment device 62 includes an adjustable bearing member 64 having a bearing post 66 and two line guides 68 and 70. The guides 68 and 70 ride in two recesses 72 and 74 in the frame members 34 and 36. The bearing member 64 has a pair of guide members 77 and 78 which extend into guide slots 80 and 82 in the frame members 34 and 36. A support post 84 is held in frame members 34 and 36 by means of rivets 86 and 87, shown in FIG. 8. The support post 84 has an adjustment screw 89 threaded therein. The adjustment screw 89 is secured to bearing post 66 and has an adjustment knob 90 secured to it. FIG. 6 shows one path for the lowering line 14 in the lowering control mechanism 20. Adjustment of screw 89 varies the area of contact between sections 91 and 92 of the lowering line 14. A scale 93 and indicator 94, shown in FIG. 3, provide for an indication of rate of descent setting.

Figure 9:
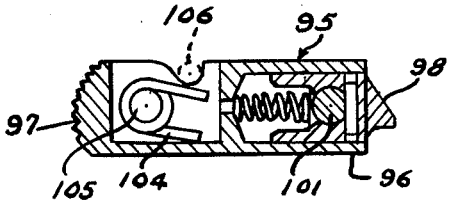
FIG. 9 is a sectional view of the braking mechanism for the device of FIGS. 5 and 6 taken along the line 9—9 in FIG. 5.

The brake member 95 includes a lever arm 96 having a serrated surface 97 for engaging the line 14. The brake member, shown in greater detail in FIG. 9, has a spring loaded latch member 98 which engages pin 99 to keep the serrated surface 97 out of engagement with the line 14. A bar 101 is attached to latch member 98 and is movable in slot 102, shown in FIG. 3, to release the latch member 98 from pin 99. A spring 104 is positioned around a pivot pin 105 and operates against pin 106 to urge the surface 97 against line 14 and to grip the line between the hook 38 and surface 97 to stop movement of the lowering control mechanism along the line.

In the operation of the device, should an aircrewman become marooned in a tall tree he can use the device of the invention to lower himself from the tree to the ground. First the line 22, toggle 30 and lowering mechanism 20 is extracted from bag 12 by pulling on loop 22. The line 22 is then passed around a support member, such as the parachute risers, and toggle 30 is inserted in a loop 32. The knob 90 is then adjusted to set the desired rate of descent. Since the rate of descent is partially determined by the weight of the aircrewman, each aircrewman would have to learn how to adjust the device for his particular weight. The aircrewman would then release the parachute risers from the parachute harness and lower himself to the ground.

The brake can either be left latched or can be unlatched and controlled by the aircrewman.

Adjustment of the descent control mechanism may not be possible once the aircrewman starts his descent; however, the aircrewman can further control his rate of descent in a conventional manner by hand controlling the entry of the line into the lowering control mechanism and with the use of the brake member.

Figure 10:
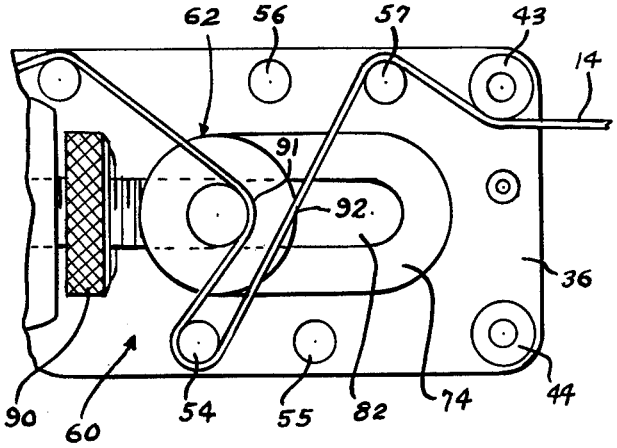
FIG. 10 is a partially cut away view of the device of FIG. 6 showing another path for the lowering line in the descent control mechanism.

Since the weight of the aircrewman partially determines the rate of descent, very light aircrewmen may not be able to use the device with the line having the path through the descent control device as shown in FIG. 6. In this case, the path may be changed to that shown in FIG. 10, so that the descent control device can be adjusted so that there is no contact between sections 91 and 92 of line 14.

Figure 11:
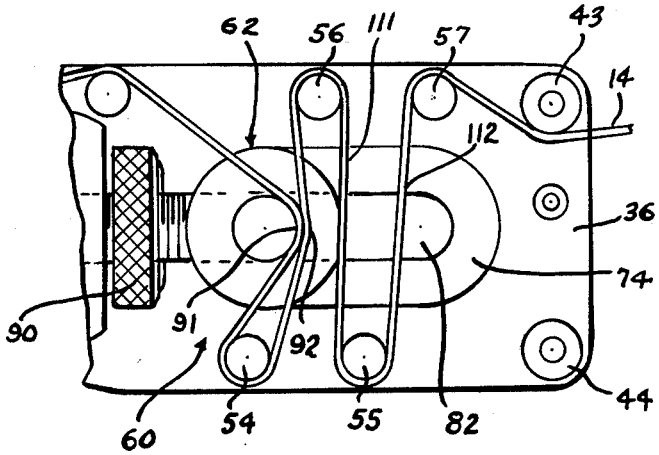
FIG. 11 is a partially cut away view of the device of FIG. 6 showing a further path for the lowering line in the descent control mechanism.

For very heavy aircrewmen the line can have a path through the descent control device as shown in FIG. 11. In this arrangement, by passing the line 14 over roller guides 54, 55, 56 and 57, in addition to the contact sections 91 and 92, the sections 111 and 112 of line 14 can be used to provide a greater area of contact between different portions of the line.

There is thus provided a more compact emergency personnel lowering apparatus which is much more flexible as to use than prior art systems.

We claim:

1. A lowering control mechanism for use in controlling the descent of a person along a lowering line, comprising: a support frame, including two spaced frame members, with said lowering line having a portion passing through the support frame between the frame members; a pair of aligned elongated slots in said frame members; a descent control mechanism within said support frame; said descent control mechanism including a bearing member; a plurality of first guide rollers on one side of said elongated slots; a plurality of second guide rollers on the opposite side of the elongated slots from said first guide rollers; said lowering line passing through said support frame along a path across said bearing member and around at least one of said first guide rollers and at least one of said second guide rollers, whereby the lowering line has at least two sections crossing the space between the elongated slots; means connected to said bearing member and engaging said elongated slots for controlling movement of the bearing member in a direction along the longitudinal axis of said slots; means connected to said bearing member for changing the contact area between the sections of the lowering line crossing the space between the elongated slots; means for securing the lowering control mechanism to a person using the lowering control mechanism.

2. The device as recited in claim 1 including a support post within said support frame adjacent said bearing member; said means for changing the contact area between the sections of the lowering line including a screw member threaded into said support post and connected to said bearing member; means, connected to said screw member for rotating said screw to thereby position the bearing member along said elongated slots.

3. The device as recited in claim 2 wherein the lowering line passes through the support frame along a path around at least two guide rollers on one side of the elongated slots and at least two guide rollers on the other side of the elongated slots.

4. The device as recited in claim 1 wherein said means for securing the lowering control mechanism to the person using the lowering control mechanism includes a hook member rigidly secured between said frame members; a brake level arm pivotably supported between said frame members adjacent to said hook member; said lever member having a serrated end portion adapted to grip the lowering line adjacent said hook member; resilient means, for moving the serrated end portion of the lever arm into lowering line gripping relation to the hook member; latch means on said lever arm, for holding the serrated end portion of the lever arm out of engagement with the lowering line and means connected to said latch means for selectively releasing said latch means.

5. The device as recited in claim 3 wherein said means for securing the lowering control mechanism to the person using the lowering control mechanism includes a hook member rigidly secured between said frame members; a brake lever arm pivotably supported between said frame members adjacent to said hook member; said lever member having a serrated end portion adapted to grip the lowering line adjacent said hook member; resilient means, for moving the serrated end portion of the lever arm into lowering line gripping relation to the hook member; latch means on said lever arm, for holding the serrated end portion of the lever arm out of engagement with the lowering line and means connected to said latch means for selectively releasing said latch means.

6. The device as recited in claim 5 in combination with a stowage bag; said lowering line, having a portion passing through the support frame of the lowering control mechanism, being stowed in a plurality of hanks within the stowage bag; said lowering control mechanism being stowed adjacent said hanks within the stowage bag; an attachment line secured to the lowering line on the side of the lowering control mechanism remote from the side where the hanks are secured; said attachment line including means for securing the attachment line to a support member; said attachment line having a section of line extending external to the stowage bag and forming a pull loop for extracting the attachment line and lowering control mechanism from said stowage bag.

* * * * *